US010094250B2

(12) United States Patent
Nair et al.

(10) Patent No.: US 10,094,250 B2
(45) Date of Patent: Oct. 9, 2018

(54) VALVE BRIDGE WITH INTERNAL OIL TRANSPORTATION

(71) Applicant: Progress Rail Locomotive Inc., LaGrange, IL (US)

(72) Inventors: Adarsh Gopinathan Nair, Darien, IL (US); Laura E. Rasmussen, Brookfield, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 1 day.

(21) Appl. No.: 15/240,552

(22) Filed: Aug. 18, 2016

(65) Prior Publication Data

US 2018/0051597 A1 Feb. 22, 2018

(51) Int. Cl.

| | |
|---|---|
| ***F01L 1/18*** | (2006.01) |
| ***F01L 1/24*** | (2006.01) |
| ***F01L 1/14*** | (2006.01) |
| *F01L 1/26* | (2006.01) |
| *F01L 1/46* | (2006.01) |

(52) U.S. Cl.

CPC ..... *F01L 1/2411* (2013.01); *F01L 1/146* (2013.01); *F01L 1/181* (2013.01); *F01L 1/26* (2013.01); *F01L 1/46* (2013.01); *F01L 2001/2444* (2013.01); *F01L 2810/02* (2013.01)

(58) Field of Classification Search

CPC ... F01L 1/2411; F01L 1/26; F01L 1/46; F01L 2810/02

USPC ..... 123/90.4, 90.46

See application file for complete search history.

(56) References Cited

U.S. PATENT DOCUMENTS

| | | | | |
|---|---|---|---|---|
| 7,500,466 | B2 * | 3/2009 | Noss | F01L 1/267 123/321 |
| 8,210,144 | B2 | 7/2012 | Langewisch | |
| 9,309,788 | B2 | 4/2016 | Nair et al. | |
| 9,347,383 | B2 | 5/2016 | Janak et al. | |
| 2005/0211206 | A1 * | 9/2005 | Ruggiero | F01L 1/08 123/90.16 |
| 2010/0170472 | A1 * | 7/2010 | Yang | F01L 1/08 123/321 |
| 2011/0079195 | A1 * | 4/2011 | Dilly | F01L 1/24 123/321 |
| 2013/0319370 | A1 | 12/2013 | Yang | |
| 2015/0021508 | A1 * | 1/2015 | Nair | F01L 1/2411 251/366 |
| 2015/0101567 | A1 * | 4/2015 | Park | F01L 1/267 123/321 |

(Continued)

*Primary Examiner* — Jorge Leon, Jr.
(74) *Attorney, Agent, or Firm* — Miller, Matthias & Hull

(57) ABSTRACT

A valve bridge is disclosed for use with an internal combustion engine. The valve bridge may include a body with a central cavity formed in a center portion of the body for receiving a hydraulic lash adjuster, and opposing first and second lateral extensions on opposite sides of the central cavity. The valve bridge may further include a first bore in the first extension for receiving a first valve stem, and a second bore in the second extension for receiving a second valve stem. The valve bridge may also include a first internal groove in a wall of the central cavity configured to receive fluid, as well as a first internal passage in the body that extends from the first internal groove toward the first bore. In addition, the first internal passage may extend from a higher gravitational point within the body to a lower gravitational point within the body.

18 Claims, 3 Drawing Sheets

(56) References Cited

U.S. PATENT DOCUMENTS

| | | | | |
|---|---|---|---|---|
| 2016/0017765 | A1* | 1/2016 | Gron | F01L 1/146<br>123/90.12 |
| 2016/0084122 | A1* | 3/2016 | Baltrucki | F01L 9/023<br>123/90.12 |
| 2016/0201523 | A1 | 7/2016 | Cyborski et al. | |
| 2016/0201524 | A1* | 7/2016 | Cyborski | F01L 1/26<br>123/90.1 |
| 2016/0369660 | A1* | 12/2016 | Junker | F01L 1/181 |

* cited by examiner

VALVE BRIDGE WITH INTERNAL OIL TRANSPORTATION

TECHNICAL FIELD

The present disclosure generally relates to a valve bridge and, more particularly, relates to a valve bridge having internal grooves and passages for oil transportation therein.

BACKGROUND

Each cylinder of an internal combustion engine is equipped with one or more gas exchange valves (e.g., intake and exhaust valves) that are cyclically opened during normal engine operation. In a conventional engine, the valves are opened by way of a camshaft/rocker arm configuration, which may additionally include a push rod. The camshaft includes one or more lobes arranged at particular angles corresponding to desired lift timings and amounts of the associated valves. The cam lobes are connected to stem ends of the associated valves by way of the push rod, rocker arm and associated linkage components. As the camshaft rotates, the cam lobes or push rods engage a first pivoting end of the rocker arm, thereby forcing a reciprocal movement of a second pivoting end of the rocker arm. This pivoting motion of the rocker arm translates to lifting and releasing or opening and closing of the associated valves. When a cylinder is equipped with more than one of the same type of gas exchange valves (e.g., more than one intake valve and/or more than one exhaust valve), all valves of the same type are typically opened at about the same time. And in order to reduce the number of camshafts, cam lobes, push rods and/or rocker arms required to open the multiple valves, a valve bridge is often used to interconnect the same type of valves with a common rocker arm.

A valve bridge generally includes a valve bridge body having a central portion and two lateral extensions. Each of the lateral extensions of the valve bridge includes a bore to receive valve stem ends. The rocker arm engages a center portion of the valve bridge between the lateral extensions. With this configuration, a single pivoting motion imparted to the center of the valve bridge by the rocker arm results in lifting of the paired valves by about the same amount and at about the same timing. A lash adjuster may be included between a cam follower and a push rod, between a push rod and a rocker arm, or in the valve bridge itself. Lash adjusters function to remove clearance that exists between the valves and corresponding seats (and/or between other valve train components) when the valve is released by the rocker arm. The lash adjuster helps to ensure sealing of the cylinder during the ensuing combustion process.

An exemplary valve bridge is disclosed in U.S. Pat. No. 9,309,788 that issued to Nair et al. on Apr. 12, 2016 ("the '788 patent"). Specifically, the '788 patent discloses a T-shaped valve bridge having a center portion and lateral extensions located at opposing sides of the center portion. A bridge cavity is formed within the center portion to receive a lash adjuster, and bores are formed within the lateral extensions to receive stem ends of associated engine valves. The lash adjuster includes a plunger, an adjuster sleeve and a check valve assembled within the bridge cavity. Additionally, the '788 valve bridge includes replaceable sleeve inserts received in the bores of the lateral extensions, the sleeve inserts configured to provide lubricating oil from a central opening therein. As such, the sleeve inserts receive valve stems and protect the valve bridge from potential damage and wear imparted thereon through friction and movement between the valve bridge and the valve stems.

Although the valve bridge of the '788 patent may be suitable for many applications, it may still be less than optimal. Specifically, for valve train components to function properly and to reduce the wear thereon, sufficient oil lubrication of the parts during engine operation is required. This is true for engines having cylinders disposed in an "in-line" configuration, as well as for engines having cylinders disposed in a "V" configuration. However, where cylinders are inclined in the V configuration, the inboard side of the valve bridge and valves are at a higher elevation than the same components on the outboard side. As such, any non-pressurized flow of oil within or on a valve bridge of a V-engine assembly requires fluid flow against gravity. Valve bridges without centrally located lash adjusters may include passages within the valve bridge body from a center portion of the valve bridge to inboard and outboard sides of the valve bridge. In such valve bridges, pressurized oil from the rocker arm may be easily transported against gravity to the inboard side of the valve bridge, thereby providing lubrication to the inboard, stem-receiving bore of the valve bridge and ultimately to the valve stem and rotator.

This pressurized oil transportation through the valve bridge is not necessarily present in valve bridges having centrally located lash adjusters, like that of the '788 patent. While the '788 valve bridge may be employed in any internal combustion engine, including in-line or V-engines, such valve bridges employed in V-engines may receive less lubricating oil on the inboard side of the valve bridge, thereby rendering them more vulnerable to wear and damage imparted through frictional contact with the valve stem. Specifically, any oil splashed onto the valve bridge or oil leaked from the valve side of the rocker arm, valve bridges and lash adjusters automatically travels under gravity in an outboard direction and needs to travel against gravity to reach inboard valve stems and valve rotators. Without such lubrication and protection, the valve bridge may wear significantly faster and need to be replaced after a shorter period of operation, thereby increasing the overall operating expenses of the engine. Accordingly, it would be beneficial to provide a valve bridge having a centrally located lash adjuster that also allows for gravitational flow of oil to the inboard side of the valve bridge and valves, as well as to the outboard components, even when inclined for V-engine configurations. Such a valve bridge may allow for oil splashed onto the valve bridge, as well as oil leaked from the lash adjuster, to be transported to both the inboard and outboard bores of the valve bridge, valve stems received therein and valve rotators associated therewith. In addition, oil distribution to both inboard and outboard valves may be further improved by providing sleeve inserts within valve bridge bores that enable broader distribution of oil within the bore.

SUMMARY

In accordance with one aspect of the present disclosure, a valve bridge is disclosed which may include a body having a central cavity formed within a center portion of the body for receiving a hydraulic lash adjuster, and opposing first and second lateral extensions on opposite sides of the central cavity. The first extension may have a first bore for receiving a first valve stem and the second extension may have a second bore for receiving a second valve stem. The disclosed valve bridge may further include a first internal groove in a wall of the central cavity that is configured to receive fluid. In addition, the valve bridge may include a first internal passage in the body that extends from the first internal groove toward the first bore, the first internal passage extending from a higher gravitational point within the body to a lower gravitational point within the body.

In accordance with another aspect of the present disclosure, an engine assembly including at least two engine valves is disclosed. The engine assembly may include a valve bridge having a central cavity extending into a center portion of the valve bridge, and lateral extensions on opposite sides of the central cavity, the lateral extensions each having a bore for receiving a corresponding valve stem of the engine valves. The disclosed engine assembly may further include a hydraulic lash adjuster disposed within the central cavity of the valve bridge. In addition, the engine assembly may include internal grooves in the valve bridge between a central cavity wall and the hydraulic lash adjuster, the grooves configured to receive leaked hydraulic fluid from the hydraulic lash adjuster. And the engine assembly may also include internal passages in the valve bridge that are in fluid communication with the internal grooves, the internal passages extending from the central cavity through a portion of the lateral extensions and in fluid communication with the bores.

In accordance with another aspect of the present disclosure, a sleeve insert configured to be removably disposed in a bore of a valve bridge assembly and to receive a valve stem is disclosed. The disclosed sleeve insert may include a substantially cylindrical body having a closed top wall, an open bottom and a substantially cylindrical side wall. In addition, the sleeve insert may include at least one groove in the top wall that is in fluid communication with a groove in the substantially cylindrical side wall.

These and other aspects and features of the present disclosure will be better understood when read in conjunction with the accompanying drawings.

BRIEF DESCRIPTION OF THE DRAWINGS

FIG. 6 is a cross-sectional view of the sleeve insert of FIG. 5 disposed in a bore of the exemplary valve bridge of FIG. 2 and illustrating the fluid flow path there through.

Figure 1:
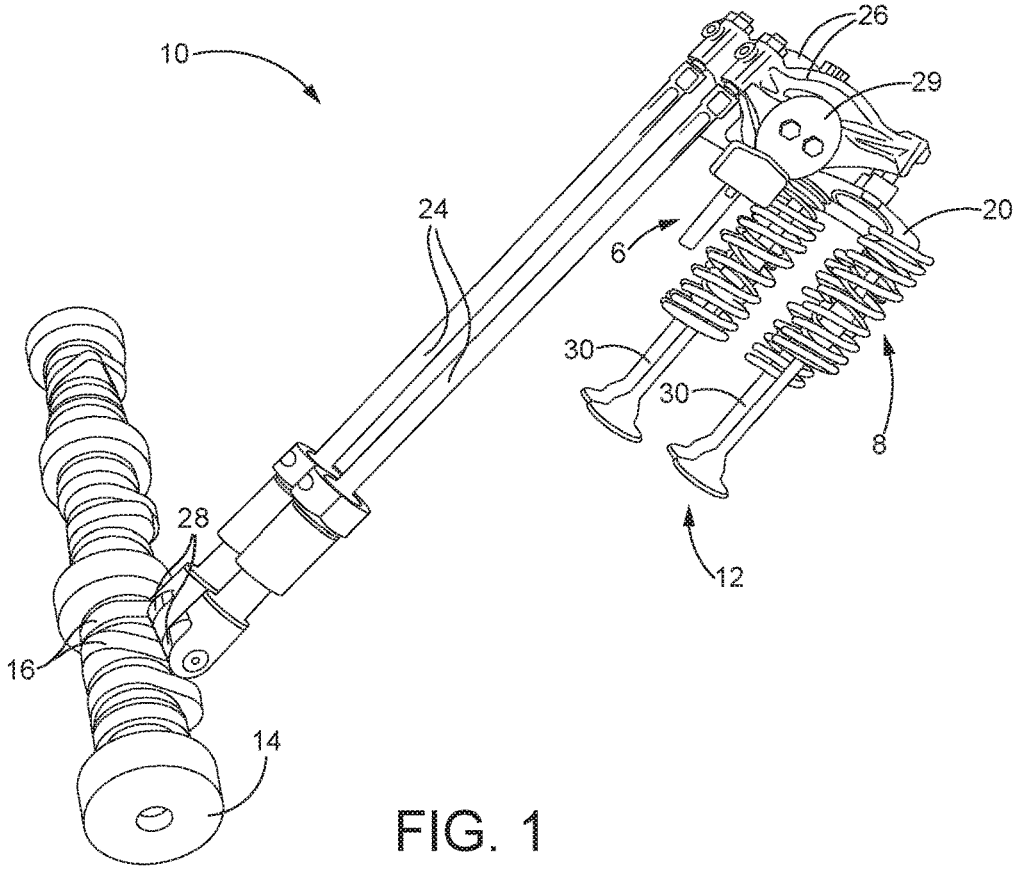
FIG. 1 is a perspective view of a valve train for an internal combustion engine having cylinders disposed in a V configuration.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

The present disclosure is directed to a valve bridge for an internal combustion engine. While the disclosed embodiments of valve bridges have particular advantages when employed in engines having cylinders arranged in a V configuration, the disclosed valve bridges may be used in engines having cylinders in an in-line configuration, a radial configuration, opposing-piston configuration, etc. In addition, the disclosed embodiments of valve bridges may be employed in gas or diesel-based internal combustion engines of any size and with any number of cylinders. Although not shown in the Figures, it should be appreciated that the internal combustion engine may include an engine block defining a plurality of cylinders. Each cylinder contains a piston that reciprocates therein. Each piston is connected to a common crankshaft through a connecting rod, such that the reciprocating movement of the pistons turns the crankshaft. Thus, the linear movement of the pistons may be translated into rotational motion to produce useful work in a machine with which the internal combustion engine is associated. Engines employing the disclosed valve bridges may be used to power any machine or other device, including on-highway trucks or vehicles, off-highway trucks or machines, earth moving equipment, generators, aerospace applications, locomotive applications, marine applications, pumps, stationary equipment and other engine powered applications.

In engines having cylinders disposed in the V configuration, the cylinders are aligned in two separate planes or "banks" disposed in a V manner such that they may create about a 45 degree angle when viewed from the axis of the crankshaft. Therefore, elements of a valve train for a V-engine, including valves, valve stems, valve rotators and valve bridges, may be at about a 22.5 degree angle with respect to the vertical axis. This angle defined by the banks may be slightly or significantly larger, for example, an angle between about 60 and about 90 degrees. Accordingly, the elements of a valve train associated with such a configuration may also be disposed at a larger angle with respect to the vertical axis. Alternatively, the angle defined by the banks may be smaller, depending on the specific application. For the purpose of this disclosure, when referencing the inboard or outboard side of a valve bridge, the inboard side is the side closest to the vertical while the outboard side is the side furthest from the vertical. As such, in a V-engine configuration, a valve bridge inboard side 6 is positioned at a higher gravitational point than an outboard side 8, as depicted in the valve train 10 of FIG. 1.

FIG. 1 illustrates a conventional valve train 10 and its associated gas exchange valves 12 for an internal combustion engine having the cylinders disposed in the inclined V configuration, the valve train 10 shown apart from the engine block and head, within which the valve train 10 is mounted. The valve train 10 includes a rotating camshaft 14 having intake and exhaust cams 16. Gas exchange valves 12 are operably coupled to one or more valve bridges 20 in a conventional manner, the valves 12 received on an inboard side 6 of the valve bridge 20 or on an outboard side 8 of the valve bridge 20. Push rods 24 may extend from the cams 16 to their associated rocker arms 26. One end the push rods 24 include rotating cam followers 28 that roll on the outer surface of their respective cams 16 when the engine is in operation. The opposite end of the push rods 24 engage one side of the rocker arms 26 causing the rocker arms 26 to pivot about a pivot point or shaft 29 thereby creating a corresponding reciprocating motion by the other side of the rocker arm 26 that lifts and releases the valve bridge 20 and valves 12. As illustrated, the rocker arms 26 may be connected to the valves 12 through the valve bridges 20 that receive valve stems 30 of the valves 12. Therefore, as the camshaft 14 rotates, the push rods 24 transfer the rotary motion of the camshaft 14 into a linear motion of the valves 12 via the rocker arms 26 and the valve bridges 20. It is to be appreciated that the present disclosure could also apply to engines with overhead cams in which push rods may be eliminated without departing from the intended scope of the present disclosure. While not illustrated in FIG. 1, it is common for valve trains 10 to include hydraulic lash adjusters that employ hydraulic fluid, for example, engine lubricating oil, and that function to maintain near zero clearance of the valves 12 when the engine is in operation. A hydraulic lash adjuster may be disposed, for example, between the cam follower 28 and the push rod 24, between the push rod 24 and the rocker arm 26, in the rocker arm 26 at the valve end, or in the valve bridge 20.

Figure 2:
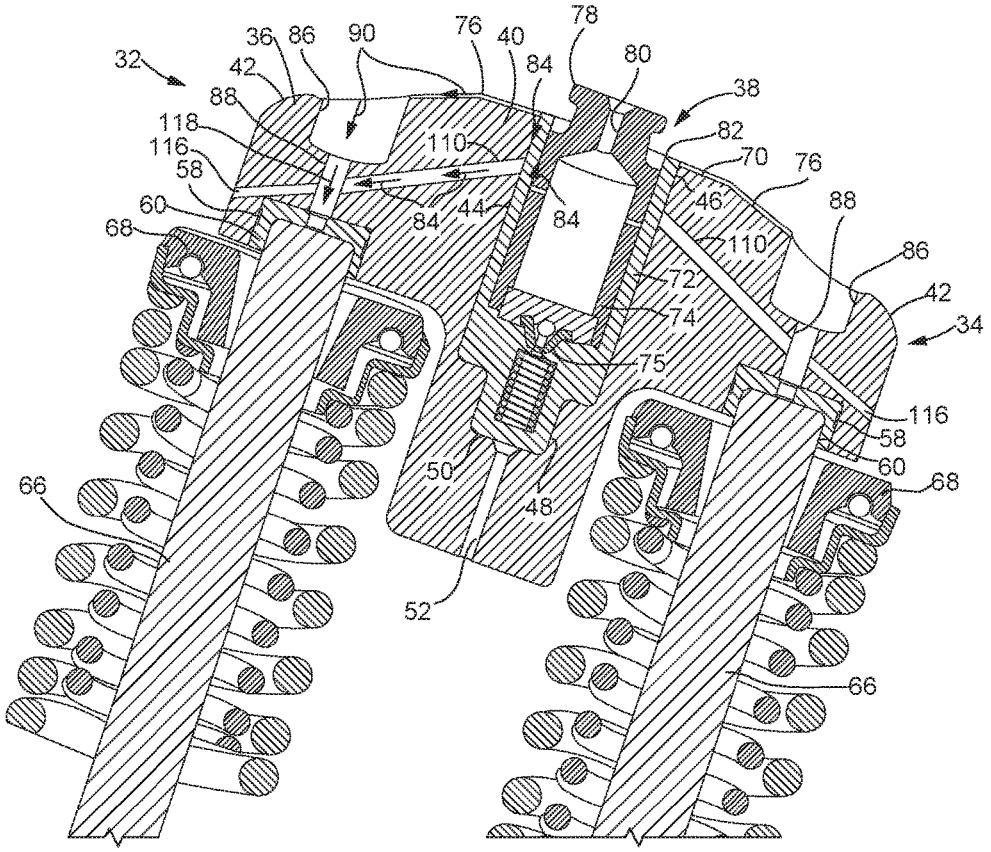
FIG. 2 is a cross-sectional view of an exemplary valve bridge assembly illustrating fluid flow paths to an inboard side of the valve bridge assembly.

FIG. 2 illustrates an inclined valve bridge assembly having an inboard side 32 and an outboard side 34, the elements of the inboard side 32 being at a higher gravitational point than the corresponding elements of the outboard side 34, as typical in V-engine configurations. FIG. 2 also illustrates fluid flow paths on and within the inboard side 32 of the valve bridge 36 (as described in detail below). It is to be appreciated that like flow paths exist on the outboard side 34 of the valve bridge 36. The valve bridge assembly includes an exemplary valve bridge 36 that incorporates a hydraulic lash adjuster 38 removably disposed in a center portion 40 of the body of the valve bridge 36. The valve bridge 36 may include a generally T-shaped body with lateral extensions 42 protruding outward from opposing sides of the central portion 40. A stepped bore may form a central cavity 44 within the center portion 40, and may include a larger diameter at an open end 46 and a smaller diameter at a closed end 48. A shoulder 50 may be formed axially between the open end 46 and the closed end 48, and a drain passage 52 may be generally aligned with the cavity 44 and formed within the closed end 48. The drain passage 52 may connect to the cavity 44 and may function both to drain excess fluid from the cavity 44 as well as to provide access for a lash adjuster removal tool. Additional bores 58 may be formed within the valve bridge 36 at the lateral extensions 42 to receive sleeve inserts 60. The sleeve inserts 60 may be removably disposed in the bores 58 and may be oriented so as to receive valve stems 66, which may have valve rotators 68 associated therewith. Components of the valve bridge assembly including the valve bridge 36, the lash adjuster 38 and the sleeve inserts 60 may be of any material known in the industry, for example, forged steel, cast steel, machined steel, etc. In addition, the below described cavities, bores, grooves, passageways, etc. may likewise be the result of forging, casting, machining or drilling steel for the intended purpose.

The hydraulic lash adjuster 38 may be a sub-assembly of components that make up a single integral unit within the valve bridge 36 or may be a replaceable cartridge-style, centrally located hydraulic lash adjuster. The lash adjuster 38 may interrupt a top surface 70 of the valve bridge 36 by being inserted into the cavity 44 of the central portion 40 of the valve bridge body. The hydraulic lash adjuster 38 components may include, among other things, an adjuster sleeve 72, a plunger 74 and a check valve assembly 75. The adjuster sleeve 72 may be a hollow body that is loosely fitted (or press-fitted in some applications) into the central cavity 44. The plunger 74 may be slidingly disposed within the adjuster sleeve 72. The check valve assembly 75 may be disposed between internal ends of the adjuster sleeve 72 and the plunger 74. A worn lash adjuster 38 may be removed from the valve bridge 36 by inserting a removal tool into the drain passage 52 and pushing upward on the closed bottom of the adjuster sleeve 72. It should be noted that in some embodiments and/or applications, the worn lash adjuster 38 may slide out of the valve bridge 36 without the use of a removal tool. A replacement lash adjuster may then be inserted back into the central cavity 44. The exterior of the adjuster sleeve 72 may be stepped so as to generally match the stepped profile of the cavity 44, and the interior of the adjuster sleeve 72 may mimic the exterior. The plunger 74 may be slidingly received within the larger interior diameter of the adjuster sleeve 72, while the check valve assembly 75 may be press-fitted into the smaller interior diameter. The check valve assembly 75 may take any conventional configuration known in the art, and function to selectively allow fluid from within the plunger 74 to enter a hydraulic chamber of the adjuster sleeve 72 below a rim of the plunger 74. This fluid may then become trapped in the lower hydraulic chamber of the adjuster sleeve 72 and facilitate load transfer from a rocker arm to valves.

An external end surface 78 of the plunger 74 may protrude a distance out of the adjuster sleeve 72 and may function as the planar engagement surface of the valve bridge assembly with a button, for example, of a rocker arm (not shown). A lubrication passage 80 may extend from this engagement end surface 78 through the closed end of the plunger 74 to an interior of the plunger 74. The lubrication passage 80 may function to direct pressurized lubricant from a rocker arm into the lash adjuster 38. During operation of the engine and the lash adjuster 38, fluid may exit the lash adjuster 38 at an open end 82 of the adjuster sleeve 72 thereby creating a fluid flow path 84 out of the hydraulic lash adjuster 38 and into the valve bridge 36, as described in detail below.

Figure 3:
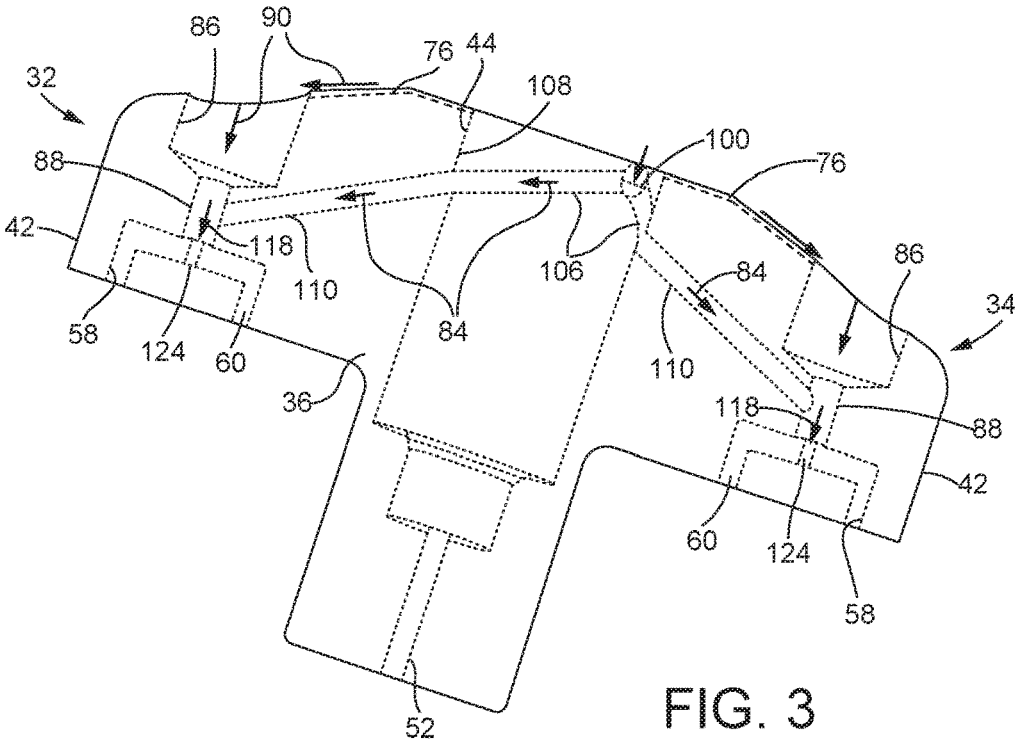
FIG. 3 is a transparent plan view of the valve bridge of FIG. 2 illustrating fluid flow paths to inboard and outboard sides of the valve bridge.
Figure 4:
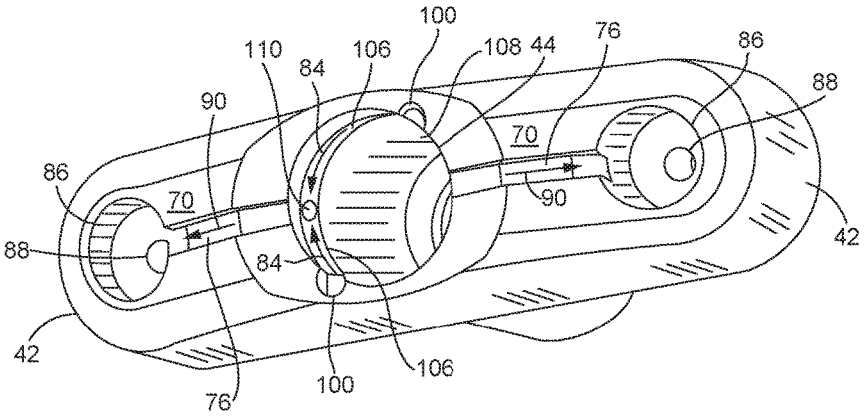
FIG. 4 is a perspective view of the exemplary valve bridge of FIG. 2 also illustrating fluid flow paths to inboard and outboard sides of the valve bridge.

As also illustrated in FIG. 2, the top surface 70 of the valve bridge 36 may slope downward toward a lower surface of the valve bridge 36 from the central portion 40 toward the lateral extensions 42. A gravity feed top groove 76 may extend from the central cavity 44 outward along the slope to a generally cylindrical collection reservoir 86 located at each of the lateral extensions 42. In addition, the opposing top grooves 76 may include a steeper incline than that of the downwardly-sloped top surface 70, further facilitating the gravitational fluid flow to the collection reservoirs 86. The collection reservoirs 86 may be configured to fill with oil provided from the top grooves 76 on the valve bridge 36 and from other sources. Specifically, splashed oil or oil leaked from a rocker arm bushing or other parts of the engine assembly during operation may be collected in the top groove 76 and flow, using gravity and under normal atmospheric pressure, down the top groove 76 and into the reservoir 86 (see also FIGS. 3 and 4). An axially-oriented passage 88 may connect the collection reservoir 86 to the associated and oppositely oriented bore 58, thereby facilitating lubrication of the bore 58 and the sleeve insert 60 disposed therein. The passage 88 may have an internal diameter less than an internal diameter of the collection reservoir 86. This diametrical relationship may help a supply of fluid to build within the collection reservoir 86, while still providing lubrication to the bore 58 and the sleeve insert 60. The fluid flow path from the top surface 70 through the top groove 76 and into the collection reservoir 86 and into the passage 88 is illustrated in FIGS. 2-4 by arrows 90.

The fluid flow path 84 is described with reference to FIGS. 2-4. While FIG. 2 illustrates the fluid flow path 84 to the inboard side 32 alone, FIG. 3 illustrates the fluid flow path 84 to both the inboard and the outboard sides 32, 34 of the valve bridge 36 through the internal structure of the valve bridge 36 (represented by hidden lines). Specifically, the fluid flow path 84 refers to the flow of oil leaked from the hydraulic lash adjuster 38, collected in pockets 100, and directed through internal grooves 106 in the central cavity 44 of the valve bridge 36 and into internal passages 110 extending from the grooves 106 through the lateral extensions 42. As described above, during normal operation of the engine and the lash adjuster 38, oil may leak from the lash adjuster 38. Such oil is not pressurized at that point and instead leaks out from the lash adjuster 38 at atmospheric pressure. Specifically, oil may exit the lash adjuster 38 at the open end 82 of the adjuster sleeve 72 from between the plunger 74 and the adjuster sleeve 72. Upon exiting the open end 82 of the adjuster sleeve 72, the leaked oil may be received in one or more fluid collection pockets 100 or indentions between the central cavity 44 and the top surface 70 of the valve bridge 36. The fluid collection pockets 100, as best illustrated in FIGS. 3 and 4, are an extension of and in fluid communication with the internal grooves 106 of the central cavity 44. While the disclosed embodiments include distinct pockets 100 at an upper end of the grooves 106, the grooves 106 may extend through the cavity 44 and directly to the top surface 70 of the valve bridge 36 and provide the same fluid collection function as the pockets 100. The grooves 106 may be in a wall 108 of the central cavity 44. As such, the grooves 106 provide a fluid flow path 84 between the wall 108 of the central cavity 44 and the adjuster sleeve 72 of the hydraulic lash adjuster 38. Each fluid collection pocket 100 may be in fluid communication with one or more internal grooves 106, the internal grooves 106 extending from a higher gravitational point to a lower gravitational point within the central cavity 44, as best illustrated in FIG. 3. In the illustrated embodiments, each fluid collection pocket 100 has two grooves 106 descending therefrom, one toward the inboard side 32 of the valve bridge 36 and the other toward the outboard side 34 of the valve bridge 36. One internal groove 106 may however suffice depending on the direction of oil flow desired. In all cases, the internal grooves 106 descend from a higher gravitational point to a lower gravitational point irrespective of their direction toward the inboard or the outboard side 32, 34 of the valve bridge 36 and irrespective of the inclination of the valve bridge 36 for a V-engine assembly.

Each internal groove 106 may ultimately connect to and be in fluid communication with an internal passage 110 that extends away from the central cavity 44 through the lateral extensions 42. The internal passages 110 may direct fluid from the internal grooves 106 to the passages 88 between the fluid reservoirs 86 and the bores 58 of the lateral extensions 42. The internal passages 110 may be drilled through the valve bridge 36 starting from the central cavity 44 and through the lateral extensions 42 until reaching the passages 88. Alternatively, the internal passages 110 may be drilled through the valve bridge 36 starting from the inboard and outboard sides 32, 34 of the valve bridge 36, through the passages 88 and toward the cavity 44 until ultimately connecting with the internal grooves 106 in the cavity wall 108. In the latter case, a pin 116 may be inserted into outer ends of the internal passages 110, thereby closing the passages 110 to the inboard and outboard sides 32, 34 of the valve bridge 36. As is the case with the internal grooves 106, the internal passages 110 extend from a higher gravitational point to a lower gravitational point irrespective of their direction toward inboard or outboard sides 32, 34 of the valve bridge 36. As depicted in FIGS. 2-4, the fluid flow path 84 descends from the fluid collection pockets 100 or from the internal grooves 106 of the cavity 44, through the internal passages 110 and into the passages 88 for ultimate fluid delivery to the bores 58 in the lateral extensions 42. The fluid flow path 84, therefore, delivers oil leaked from the hydraulic lash adjuster 38 to the bores 58 in a manner that consistently directs the fluid from a higher gravitational point to a lower gravitational point. As such, whether in a direction of the inboard or outboard side 32, 34 of the valve bridge 36, the fluid flow path 84 directs fluid using gravity and under normal atmospheric pressure.

Figure 6:
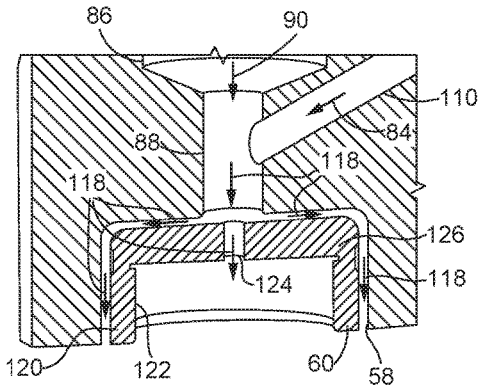

Both of the fluid flow paths 84, 90 described thus far may arrive to the fluid passage 88 where they merge before being delivered to the bore 58, the sleeve insert 60 therein, and ultimately to the valve stem 66 and the valve rotator 68 associated therewith. This fluid flow path is represented in FIGS. 2, 3 and 6 using arrows 118. With further regard to the valve bridge 36 structure, the bores 58 in lateral extensions 42 are oriented oppositely to that of the collection reservoirs 86, and therefore, are oriented so as to receive the valve stems 66. The bores 58 may be in fluid communication with the fluid collection reservoirs 86 via the passages 88. The sleeve inserts 60 may be inserted into each bore 58, the sleeve inserts 60 also oriented to receive the valve stems 66.

Figure 5:
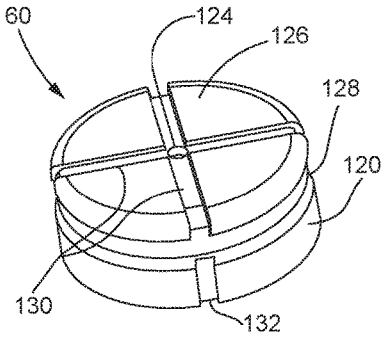
FIG. 5 is a perspective view of a sleeve insert with grooves for oil transportation that may be used in conjunction with the exemplary valve bridge of FIG. 2.

As best illustrated in FIGS. 5 and 6, the sleeve insert 60 may embody a hollow and generally cylindrical body having a side wall 120 with an outer surface configured to be press-fitted into the bore 58. A central bore 122 may be formed within the sleeve insert 60 thereby creating an open end of the sleeve insert 60 that is sized and configured to slidingly receive the valve stem 66. The fluid paths 84, 90 may be delivered from the passage 88 through an opening 124 formed in a top wall 126 of a closed end end of the sleeve insert 60. Significant amounts of fluid may or may not pass through the opening 124 of the sleeve insert 60 depending on the shape of the valve stem 66 and whether or not the end of the valve stem 66 is constantly flush with the opening 124 of the sleeve insert 60. In any case, the sleeve insert 60 may also be provided with additional grooves for fluid transport. For example, the top wall 126 of the sleeve insert 60 may include one or more grooves 130 therein for further directing fluid received from the passage 88 within and out of the bore 58. The embodiments illustrated include perpendicularly disposed grooves 130, however, any arrangement capable of directing fluid through the sleeve insert 60 is within the scope of this disclosure, including any arrangement that allows for a radial distribution of fluid through and out of the bore 58. Furthermore, the grooves 130 may be inclined in the top wall 126, thereby directing fluid toward the opening 124 or toward the side wall 120, as desired. In addition, the sleeve insert 60 may include an additional radial groove 128 around the side wall 120 that is in fluid communication with the grooves 130. Such a radial groove 128 of the side wall 120 may also be in fluid communication with an additional groove(s) 132 in the side wall 120, thereby providing a fluid flow path out of the bore 58 and to the valve stems 66 and the valve rotators 68. Like the previously described fluid flow paths 84, 90, the fluid flow path 118 directs fluid from a higher gravitational point to a lower gravitational point. As such, the fluid flows using gravity and under normal atmospheric pressure.

The fluid passage 88 may have a diameter larger than that of the opening 124 of the sleeve insert 60 with which it is axially aligned. In this configuration, a portion of the top wall 126 of the sleeve insert 60 may be visible from an upper side of the valve bridge 36 (i.e., through the fluid collection reservoir 86 and the passage 88). As such, a sleeve removal tool may be inserted through the collection reservoir 86 and the passage 88 and used to push on the top wall 126 of the sleeve insert 60, thereby dislodging the sleeve insert 60. While sleeve inserts 60 are removable and replaceable, the sleeve insert 60 may have a hardness of about the same as a hardness of the corresponding gas exchange valve stem, such that the wear caused by relative movements there between is reduced.

To aid in manufacturing and installation of the disclosed valve bridge 36, opposite sides of the valve bridge 36 or the lateral extensions 42 may be substantially identical. Specifically, each lateral extension 42 may include similarly disposed top grooves 76, internal passages 110, fluid collection reservoirs 86, passages 88 and bores 58. Likewise, the fluid collection pockets 100 and the internal grooves 106 of the central cavity 44 may be duplicated, opposite each other, on each side of the cavity 44. Oil leaked from the hydraulic lash adjuster 38 may be collected in either pocket 100 before being directed through the internal grooves 106, albeit the pocket disposed at a lower gravitational point may collect larger volumes of oil. As such, the disclosed valve bridge 36 is substantially symmetrical in shape and functionality.

INDUSTRIAL APPLICABILITY

The disclosed valve bridge may have applicability with gas or diesel-based internal combustion engines. Such engines employing the disclosed valve bridge may be used to power any machine or other device, including on-highway trucks or vehicles, off-highway trucks or machines, earth moving equipment, generators, aerospace applications, locomotive applications, marine applications, pumps, stationary equipment and other engine powered applications. Further, the valve bridge may be used to lift multiple gas exchange valves (e.g., intake valves and/or exhaust valves) at the same time and by the same amount. The valve bridge may have easily replaceable components, which allow it to be renewed and reused, resulting in lower operating costs for the engine owner.

While the disclosed valve bridge offers particular advantages when employed in engine assemblies having cylinders arranged in a V configuration, the disclosed valve bridge may be employed in any other engine assembly having any number of cylinders. Because nearly all engine components function more efficiently and incur less wear and tear when well lubricated, the present disclosure is directed to a valve bridge that provides additional oil or fluid flow paths on and within the valve bridge for such a purpose. Specifically, the presently disclosed valve bridge provides for transportation of oil along a sloping top surface of the valve bridge and from a centrally located lash adjuster through lateral extensions to both an inboard and outboard side of the valve bridge. In all cases, the disclosed fluid flow paths are directed from a higher gravitational point to a lower gravitational point, thereby allowing fluid flow using gravity and at normal atmospheric pressure, even in V-engine configurations where the inboard components are elevated relative to the outboard components.

Many of the conventional components of a valve train of an internal combustion engine in the V configuration, including the valve bridge and valve stems, may be disposed at about a 22.5 degree angle to the vertical axis. As described above, this angle may be more or less, depending on the exact configuration of the cylinder banks. Therefore, in conventional valve bridges, non-pressurized oil, such as that which is leaked from a hydraulic lash adjuster 38, may tend to flow toward and accumulate on the outboard side 34 of the valve bridge 36 due to the lower gravitational position of the outboard side 34. The presently disclosed valve bridge 36 includes fluid flow paths 84, 90, 118 that provide oil leaked from the lash adjuster 38, as well as oil splashed or otherwise received onto the top surface 70 of the valve bridge 36, to flow using gravity and under atmospheric pressure from a more central location on the valve bridge 36 to the bores 58 on both inboard and outboard sides 32, 34. Within the bores 58, the oil may be distributed in various directions to the valve stems 66 and the valve rotators 68 via the sleeve inserts 60 disposed within the bores 58.

With regard to the fluid flow path 84, during normal operation of the engine and the centrally localized hydraulic lash adjuster 38, oil leaks at atmospheric pressure out of the open end 82 of the adjuster sleeve 72 from between the adjuster sleeve 72 and the plunger 74 of the hydraulic lash adjuster 38. As best depicted in FIGS. 3 and 4, oil leaked out from the hydraulic lash adjuster 38 may be collected in one or more pockets 100 to thereafter flow using gravity into and through the internal grooves 106 in the central cavity wall 108 between the central cavity 44 and the adjuster sleeve 72. The fluid flow path 84 directs fluid from the internal grooves 106 into the internal passages 110 with which they are in fluid communication. Because the fluid flow path 84 within the grooves 106 and the passages 110 extends from a higher gravitational to a lower gravitation point, oil leaked from the hydraulic lash adjuster 38 may flow, using gravity, from the hydraulic lash adjuster 38 through the lateral extensions 42. This gravitational flow of oil may be achieved on both the inboard and outboard sides 32, 34 of the valve bridge 36, even when the valve bridge 36 is inclined for V-engine configurations. Oil in the fluid flow path 84 is further received in the passages 88 before ultimately being delivered to the bores 58 and the sleeve inserts 60 in the lateral extensions 42.

With regard to the fluid flow path 90, during normal operation of an internal combustion engine, oil may be splashed onto or otherwise received onto the top surface 70 of the valve bridge 36 of an engine assembly. This oil may also flow to both the inboard and outboard sides 32, 34 of the valve bridge 36 through the top grooves 76 in the top surface 70. Specifically, the top grooves 76 direct oil on the downwardly-sloped top surface 70 from a more centralized area of the valve bridge 36 to the fluid collection reservoirs 86 on the lateral extensions 42. Because the top grooves 76 partially extend from a higher gravitational point to a lower gravitational point, the oil therein may be delivered to the reservoirs 86 using gravity and at normal atmospheric pressure. This gravitational flow of oil may be achieved on both the inboard and outboard sides 32, 34 of the valve bridge 36, even when the valve bridge 36 is inclined for V-engine configurations. Oil in the fluid flow path 90 is further received in the passages 88 where it merges with the fluid flow path 84 before ultimately being delivered to the bores 58 and the sleeve inserts 60 in the lateral extensions 42.

Oil received in the passages 88 of the valve bridge 36 may then be distributed to the valve stems 66 and the valve rotators 68 along the fluid flow path 118. As best illustrated in FIGS. 5 and 6, the sleeve inserts 60 disposed in the bores 58 may direct the fluid through the central opening 124 therein, or through the grooves 130, 132 in the top and side walls 126, 120, respectively. One or more top wall grooves 130, and corresponding side wall grooves 132, may be disposed at any inclination or radial configuration desired to ultimately deliver the oil to the target engine parts. After a period of use, the sleeve inserts 60 may become worn. If unaccounted for, the efficiency of the valve bride in lifting and releasing the valves may become compromised. Therefore, the present disclosure provides for replaceable sleeve inserts 60. Specifically, a corresponding tool may be inserted through the collection reservoir 86 and the passage 88 at the lateral extensions 42 of the valve bridge 36 to engage the top wall 126 of the sleeve insert 60. The tool may then be pushed downward to dislodge the worn sleeve insert 60 from the bore 58. A replacement sleeve insert 60 may then be press-fitted back into the bore 58.

The improved valve bridge 36 disclosed herein overcomes a problem presented by conventional valve bridges having centrally located hydraulic lash adjusters, i.e., the hindrance of oil flow to the inboard side of the valve bridge due to its higher gravitational position in V-engine designs. Specifically, the improved valve bridge 36, having internal grooves 106, internal passages 110, top grooves 76 and sleeve inserts 60, which direct fluid flow from a higher gravitational point to a lower gravitational point, guarantee the supply of oil under gravity to both the inboard and outboard sides 32, 34 of the valve bridge 36 and valves, even when the valve bridge 36 and valves are inclined in a V-engine configuration. In turn, the valve bridge 36 is less vulnerable to the wear and damage that may be incurred from a lack of proper lubrication on the inboard side 32. In addition, the disclosed valve bridge 36, having a substantially symmetrical design and functionality, avoids any risk of dysfunction from incorrect installation/orientation of the valve bridge 36. Further, because the valve bridge 36 may be easily renewed or repaired by replacing the sleeve inserts 60, as well as the lash adjuster 38, the overall operating cost of the internal combustion engine may be lowered. Specifically, the valve bridge 36 may be reused, thereby reducing the number of replacement parts and service required.

All references to the disclosure or examples thereof are intended to reference the particular example being discussed at that point and are not intended to imply any limitation as to the scope of the disclosure more generally. Also, it will be apparent to those skilled in the art that various modifications and variations can be made to the valve bridge of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A valve bridge, comprising:

a body having a central cavity formed within a center portion of the body for receiving a hydraulic lash adjuster, and opposing first and second lateral extensions on opposite sides of the central cavity, the first extension having a first bore for receiving a first valve stem and the second extension having a second bore for receiving a second valve stem;

a first internal groove in a wall of the central cavity configured to receive fluid;

a first internal passage in the body that extends from the first internal groove toward the first bore, the first internal passage extending from a higher gravitational point within the body to a lower gravitational point within the body; and a second internal groove within the central cavity wall and wherein the first and second internal grooves of the central cavity wall extend from a higher gravitational point within the cavity to a lower gravitational point within the cavity.

2. The valve bridge of claim 1, further comprising a fluid collection pocket disposed between the central cavity wall and a top surface of the valve bridge, and wherein the fluid collection pocket is in fluid communication with the first and second internal grooves of the central cavity wall.

3. The valve bridge of claim 1, further comprising a second internal passage in the body that extends from the second internal groove within the central cavity wall toward the second bore, the second internal passage extending from a higher gravitational point within the body to a lower gravitational point within the body.

4. The valve bridge of claim 3, wherein the first and second internal passages are in fluid communication with the first and second bores.

5. The valve bridge of claim 4, further comprising a removable sleeve insert disposed within each of the first and second bores and configured to receive a corresponding valve stem, the sleeve inserts having at least one top wall sleeve groove in fluid communication with a side wall sleeve groove.

6. The valve bridge of claim 1, further comprising opposing first and second top grooves that extend along a top surface of the valve bridge from the central cavity toward the first and second bores of the lateral extensions.

7. The valve bridge of claim 6, wherein the first top groove is in fluid communication with the first bore and the second top groove is in fluid communication with the second bore.

8. An engine assembly including at least two engine valves, the engine assembly comprising:

a valve bridge comprising a central cavity extending into a center portion of the valve bridge, and lateral extensions on opposite sides of the central cavity, the lateral extensions each having a bore for receiving a corresponding valve stem of the engine valves;

a hydraulic lash adjuster disposed within the central cavity of the valve bridge;

internal grooves in the valve bridge between a central cavity wall and the hydraulic lash adjuster, the grooves configured to receive leaked hydraulic fluid from the hydraulic lash adjuster, wherein the internal grooves extend from a higher gravitational point to a lower gravitational point; and internal passages in the valve bridge in fluid communication with the internal grooves, the internal passages extending from the central cavity through a portion of the lateral extensions and in fluid communication with the bores.

9. The engine assembly of claim 8, wherein the internal passages extend from a higher gravitational point to a lower gravitational point.

10. The engine assembly of claim 8, further comprising at least one fluid collection pocket disposed between the central cavity wall and a top surface of the valve bridge, and wherein the fluid collection pocket is configured to receive hydraulic fluid leaked from the hydraulic lash adjuster and is in fluid communication with the internal grooves.

11. The engine assembly of claim 8, further comprising opposing top grooves of the valve bridge that extend along a top surface of the valve bridge from the central cavity toward the bores of the lateral extensions.

12. The engine assembly of claim 8, further comprising a sleeve insert disposed within each of the bores of the valve bridge lateral extensions and configured to receive a corresponding valve stem, the sleeve inserts having at least one top wall sleeve groove in fluid communication with a side wall sleeve groove, and wherein the sleeve inserts are configured to direct hydraulic fluid within and out of the bores.

13. The engine assembly of claim 8, further comprising a fluid flow path for hydraulic fluid leaked from the hydraulic lash adjuster, the fluid flow path extending from the internal grooves between the central cavity wall and the hydraulic lash adjuster to the internal passages of the lateral extensions and to the bores of each lateral extension.

14. The engine assembly of claim 13, wherein the fluid flow path directs fluid from a higher gravitational point to a lower gravitational point.

15. A sleeve insert configured to be removably disposed in a bore of a valve bridge assembly and to receive a valve stem, the sleeve insert comprising:

a substantially cylindrical body having a closed top wall, an open bottom and a substantially cylindrical side wall;

at least one groove in the top wall that is in fluid communication with a groove in the cylindrical side wall.

16. The sleeve insert of claim 15, further comprising at least two grooves disposed perpendicular to each other in the top wall, each groove in fluid communication with a groove in the substantially cylindrical side wall.

17. The sleeve insert of claim 15, further comprising a central opening through the top wall.

18. The sleeve insert of claim 15, wherein an outer surface of the substantially cylindrical body is configured to be press-fitted into the bore.

* * * * *